United States Patent [19]

Akiyama et al.

[11] 4,213,692

[45] Jul. 22, 1980

[54] BIAS VOLTAGE SWITCHING CIRCUIT FOR CONTROLLING CONCENTRATION OF IMAGE IN COPYING APPARATUS

[75] Inventors: Mistuo Akiyama; Shunichi Abe, both of Hachioji, Japan

[73] Assignee: Konishiroku Photo Industry Co., Ltd., Tokyo, Japan

[21] Appl. No.: 1,055

[22] Filed: Jan. 5, 1979

[30] Foreign Application Priority Data

Jan. 17, 1978 [JP] Japan ..... 53-2759

[51] Int. Cl.[2] ..... G03G 15/00

[52] U.S. Cl. ..... 355/14 D; 118/651; 118/679

[58] Field of Search ..... 355/3 R, 3 DD, 14 D; 118/647, 651, 656, 661, 671, 679, 668, 712

[56] References Cited

U.S. PATENT DOCUMENTS

| | | | |
|---|---|---|---|
| 3,654,893 | 4/1972 | Piper et al. | 355/3 DD X |
| 3,805,739 | 4/1974 | Feldeisen et al. | 355/3 DD X |
| 3,981,267 | 9/1976 | Gardiner et al. | 118/647 X |
| 4,003,650 | 1/1977 | Courtney et al. | 355/3 DD X |

*Primary Examiner*—Fred L. Braun

*Attorney, Agent, or Firm*—Bierman & Bierman

[57] ABSTRACT

A bias voltage switching circuit for an electrophotographic copying apparatus includes a series-connected string of resistors,, a constant bias voltage source in parallel with the string of resistors and a plurality of switching transistors. Each of the transistors is connected between a different junction of the series connected resistors and a common reference potential to which the constant voltage source and one end of the string of resistors is connected. Selective operation of the transistors varies the voltage output of the bias voltage switching circuit for use in controlling the concentration of the image produced by the copying apparatus.

1 Claim, 2 Drawing Figures

Figure 1:
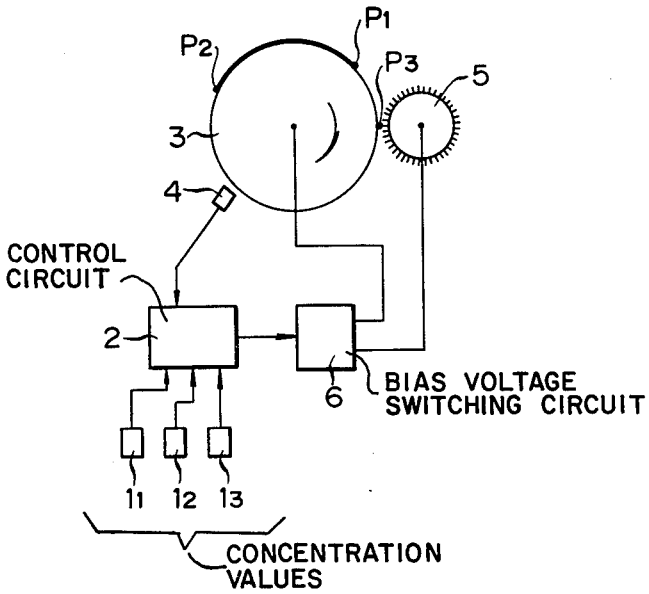

BIAS VOLTAGE SWITCHING CIRCUIT FOR CONTROLLING CONCENTRATION OF IMAGE IN COPYING APPARATUS

The present invention relates in general to an electrophotographic copying apparatus and in particular relates to a bias voltage switching circuit for changing over the bias voltage applied between a photo-sensitive medium and a developing electrode for controlling the concentration of a reproduced image in dependence on an output signal from a control circuit.

As one of the methods of controlling concentration of a reproduced image, it has been hitherto known to control the bias voltage applied between the photo-sensitive medium and the developing electrode (e.g. a magnetic toner brush) in dependence on a preset desired concentration value to be attained on the reproduced image, thereby to vary the quantity of the toner for the same level of the irradiation to which the photo-sensitive medium has been exposed.

Figure 2:
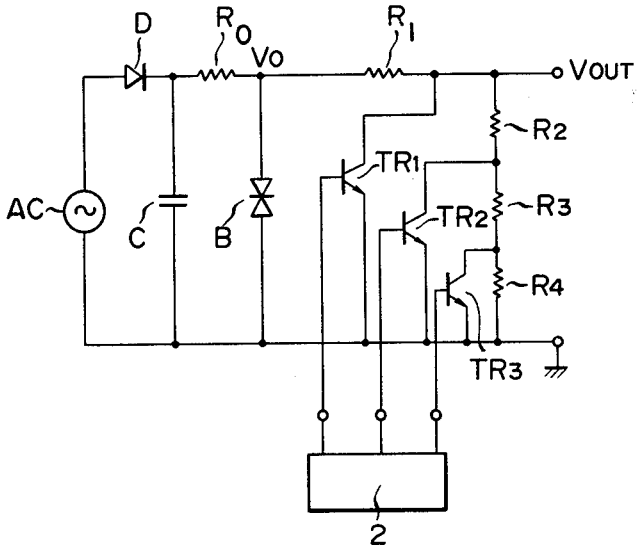

Referring to the drawings,

FIG. 1 is a schematic diagram showing a general arrangement of an image concentration control system for an electrophotographic copying apparatus, and FIG. 2 is a circuit diagram of a bias voltage switching circuit according to an embodiment of the invention for use in the concentration control system such as shown in FIG. 1.

Referring to FIG. 1 (FIG. 1 is a shcematic diagram showing a general arrangement of an image concentration control system for an electrophotographic copying apparatus) which shows a general arrangement of an image concentration control apparatus for the bias voltage control, reference numerals $1_1$, $1_2$, and $1_3$ denote concentration value setting devices for setting the values representing "thick", "normal" and "thin" concentrations for the image to be copied through manual selection. The output signal from these setting circuits 1's supplied to a control circuit 2. The photo-sensitive medium is constituted by a drum 3 which drives in the direction indicated by an arrow and the rotation angle of the drum 3 is detected by an angle sensor 4. The rotation angle signal output is applied from the sensor 4 to the control circuit 2. The surface region of the drum 3 from the leading point P1 to the trailing point P2 is exposed and an electrostatic latent image of an original is produced. The produced electrostatic light image on the surface of the drum is developed in the form of a toner image at the location P3 under the action of a magnetic brush roller 5 consisting of a developing electrode having a toner particle layer magnetically adhered thereto. When the leading point P1 on the drum 3 passes by the location P3, this is detected by the angle sensor 4, whereby the corresponding output signal from the sensor 4 supplies a switching signal to a bias voltage switching circuit 6 in dependence on the concentration value set at the devices $1_1$, $1_2$ or $1_3$. Thus, the bias voltage switching circuit 6 applies a corresponding bias voltage of a predetermined magnitude (e.g. 180 V, 280 V or 380 V) across the drum 3 and the magnetic brush roller 5.

An object of the invention is to provide a bias voltage switching circuit which allows the switching command signal from the control circuit 2 to be utilized directly as the bias voltage control signal in a simplified circuit configuration.

FIG. 2 is a circuit diagram of a bias voltage switching circuit for use in a concentration control system such as in FIG. 1, and shows an exemplary embodiment of the present invention. AC current which is supplied source AC is rectified through a diode D and smoothed by a filter capacitor C to be converted into a DC current. The DC voltage is stablized by a varistor B connected to the rectifier circuit through a protection resistor $R_0$. The source for a bias voltage having a voltage raised between both sides of the varistor B is connected to the rectifier circuit which is applied to a series connection of resistors R1, R2, R3 and R4. The bias voltage output $V_{OUT}$ is available from the junction between the resistors R1 and R2. There are connected collector-emitter paths of transistors TR1, TR2, and TR3 between the junctions of the individual resistors R1 to R4 and the reference potential terminal (or ground potential). The base or gate electrodes of the transistors TR1 to TR3 are connected to the control circuit 2 described above in conjunction with FIG. 1, whereby the transistors TR1 to TR3 are selectively turned on for a predetermined duration. For example, when set at the device $1_1$, the control circuit 2 will turn on (i.e. make conductive) the transistor TR3 for the predetermined duration.

With the circuit configuration described above, the bias output voltage $V_{OUT}$ will be 0 volt (at reference or ground potential) during the period in which the control circuit 2 turns on the transistor TR1. When the control circuit 2 renders conductive transistor TR2, the output bias voltage $V_{OUT}$ becomes equal to the source bias voltage $V_O$ divided by the resistance ratio of the resistors R1 and R2. During the conductive state of the transistor TR 3, the output bias voltage will be equal to the source voltage $V_O$ as a divided by the ratio between the resistors R1 and (R2+R3). On the other hand, when all of the transistors TR1 to TR 3 are non-conductive (or off), the output bias voltage $V_{OUT}$ will be equal to the source bias voltage $V_O$ divided by the ratio between the resistors R1 and (R2+R3+R4).

Since the bias voltage changing circuit requires a switching signal of only small magnitude for effecting ON-OFF operation of transistors TR1 to TR3, the output signal of the control circuit 2 which may be constituted by a micro-computer or the like can be utilized directly as the bias switching signal without requiring any interface device. Further, the bias voltage switching circuit may be constituted only by the resistors in number corresponding to the number of switching steps required and a corresponding number of transistors.

It will be self-explanatory that the switching steps for the bias voltages need not be restricted to four as in the illustrated embodiment but may be varied in dependence on the number of the concentration values to be employed. Moreover, the number of output terminals of the control circuit may be reduced by using an encoded series signal which is decoded at the site of the bias voltage switching circuit.

As will be apparent from the foregoing description, this invention has provided an improved bias voltage switching circuit which allows a switching control signal of a relatively small magnitude to be used for switching the bias output voltages in a simplified circuit configuration requiring only a minimum number of circuit components.

What we claim is:

1. In an electrophotographic copying apparatus for providing a produced image and which includes a photosensitive medium on which an electrostatic latent image of an original is produced and a developing electrode for developing the latent image in the form of a toner image, and in which a bias voltage applied between the photosensitive medium and the developing electrode is varied in response to a control circuit switching signal representing a preselected concentration value to be obtained in the reproduced image, the improvement comprising a bias voltage switching circuit for controlling the concentration of the reproduced image comprising:

a series connection of resistors corresponding in number to a predetermined number of switching steps of the bias voltage;

a constant bias voltage source in parallel connection with said series connection of resistors; and a plurality of switching transistors each connected between a different junction of the series connected resistors and a common reference potential to which said constant voltage bias source and one end of said series connection of resistors are connected, said plural switching transistors being turned on selectively in reponse to the control circuit switching signal so as to selectively vary the voltage output of said bias voltage switching circuit and thereby control the concentration of the reproduced image.

* * * * *